US008955339B2

(12) United States Patent
Kohler et al.

(10) Patent No.: US 8,955,339 B2
(45) Date of Patent: Feb. 17, 2015

(54) CRYOGENIC PUMP WITH A DEVICE FOR PREVENTING THE MEMORY EFFECT

(75) Inventors: Marcel Kohler, Balzers (LI); Herbert Vogt, Balzers (LI); Urs Frick, Sevenlen (CH)

(73) Assignee: HSR AG (LI)

( * ) Notice: Subject to any disclaimer, the term of this patent is extended or adjusted under 35 U.S.C. 154(b) by 198 days.

(21) Appl. No.: 13/700,425

(22) PCT Filed: May 25, 2011

(86) PCT No.: PCT/CH2011/000122

§ 371 (c)(1),
(2), (4) Date: Nov. 27, 2012

(87) PCT Pub. No.: WO2011/147042

PCT Pub. Date: Dec. 1, 2011

(65) Prior Publication Data

US 2013/0104571 A1 May 2, 2013

(30) Foreign Application Priority Data

May 27, 2010 (CH) ..... 833/10

(51) Int. Cl.
*B01D 8/00* (2006.01)
*F04B 37/08* (2006.01)

(52) U.S. Cl.
CPC ..... *F04B 37/08* (2013.01)
USPC ..... 62/55.5; 62/268

(58) Field of Classification Search
CPC ..... F04B 37/08; F04B 1/02; F04B 19/04; F04B 19/006
USPC ..... 62/55.5, 51.1, 100, 268
See application file for complete search history.

(56) References Cited

U.S. PATENT DOCUMENTS 3,131,396 A * 4/1964 Santeler et al. ..... 62/55.5
4,614,093 A * 9/1986 Bachler et al. ..... 62/55.5

(Continued)

FOREIGN PATENT DOCUMENTS

DE 2912856 A1 10/1979
DE 19632123 A1 2/1998

(Continued)

*Primary Examiner* — Mohammad M Ali
(74) *Attorney, Agent, or Firm* — Morriss O'Bryant Compagni, PC

(57) ABSTRACT

The invention relates to a device (21) for avoiding the memory effect in cryogenic pumps having a first cooling stage (23) and a second cooling stage (25) which adjoins the first cooling stage (23) in the axial direction. A cylindrical shield (31) has an opening (37) and a base (35), which base (35) is penetrated centrally by the two-stage cooling head (21) in such a way that the first cooling stage (23) is arranged outside the shield (31) and the second cooling stage (25) is arranged within the shield (31). An intermediate chamber (34) is formed between the shield (31) and the first cooling stage (23), and the base of the shield (31) is connected in a thermally conductive manner to the first cooling stage (23) by means of a thermal bridge (33). A cooling panel (43) which serves as pumping surface is connected to the second cooling stage (25) and is provided within the shield (31). A baffle (39) is arranged in the region of the opening (37) of the cylindrical shield (31) and is in thermally conductive contact with the shield (31) and/or the first cooling stage (21). The thermal bridge (33) is provided between the shield (31) and the first cooling stage (23) at a spacing from its end side (55). The invention also relates to a housing (12) which encloses the cooling head (21) and to a cryogenic pump (11), in which the cooling head (21) is accommodated.

20 Claims, 2 Drawing Sheets

(56) References Cited

U.S. PATENT DOCUMENTS

| | | | | | |
|---|---|---|---|---|---|
| 4,766,313 | A | * | 8/1988 | Homma et al. | 250/289 |
| 4,873,833 | A | * | 10/1989 | Pfeiffer et al. | 62/55.5 |
| 5,000,007 | A | * | 3/1991 | Haefner | 62/55.5 |
| 5,121,707 | A | * | 6/1992 | Kanoo | 118/725 |
| 5,231,840 | A | * | 8/1993 | Yagi et al. | 62/55.5 |
| 5,537,833 | A | * | 7/1996 | Matte et al. | 62/55.5 |
| 6,122,920 | A | * | 9/2000 | Hill et al. | 62/55.5 |
| 7,594,406 | B2 | * | 9/2009 | Murayama et al. | 62/6 |
| 8,291,717 | B2 | * | 10/2012 | Radovinsky et al. | 62/50.7 |
| 8,590,319 | B2 | * | 11/2013 | Xu | 62/6 |
| 2010/0000235 | A1 | * | 1/2010 | Tanaka | 62/55.5 |

FOREIGN PATENT DOCUMENTS

| | | | |
|---|---|---|---|
| WO | 92/08894 | A1 | 5/1992 |
| WO | 2005/005832 | A1 | 1/2005 |

* cited by examiner

CRYOGENIC PUMP WITH A DEVICE FOR PREVENTING THE MEMORY EFFECT

CROSS-REFERENCE TO RELATED APPLICATIONS

This application is a national phase entry under 35 U.S.C. §371 of PCT/CH2011/000122 filed May 25, 2011, which claims priority to Swiss Patent Application No. 833/10 filed May 27, 2010, the entirety of each of which is incorporated by this reference.

BACKGROUND OF THE INVENTION

1. Field of the Invention

The invention relates to a device for preventing the memory effect in cryogenic pumps according to the pre-characterising clause of claim 1. The invention also relates to a cryogenic pump according to claim 11.

2. Prior Art

Cryogenic pumps operated with a two-stage cold head are distinguished by a high pumping capacity and are used to generate an ultra-high vacuum ($p<10^{-7}$ mbar). Such pumps have been commercially available for over 30 years.

The pumping surface areas of the first stage are usually constructed as a cup-shaped shield and as a double-conical baffle in the region of the cup opening. The pumping surface areas of the first stage should be kept at about 80 Kelvin and serve to freeze vapour and gases with similar resublimation points.

Gases with lower resublimation points freeze on the pumping surface areas of the second stage whose temperature is less than 20 K.

At the transition from the first stage to the second stage the base of the cup-shaped shield is centrally penetrated by the cold head. Temperature zones of about 30 K consequently result in the immediate surroundings of the connecting point between cold head and base of the shield at the base.

What is referred as a memory effect is known in the case of cryogenic pumps with a two-stage cold head. There are gases which liquefy at the above-described temperature zones of about 30 K. The liquefied gases have a vapour pressure which counteracts the ultra-high vacuum which has been generated. A vacuum is established as a result of the vapour pressure and it is no longer possible to fall below this during continuous operation of the cryogenic pump. The higher the concentration of such gases which can liquefy at about 30 K is in the atmosphere to be removed by suction, the more serious the memory effect is on the vacuum to be achieved.

Two proposals are known commercially (which are designed) to prevent this memory effect. Firstly the temperature zones at the base of the shield are heated in an obvious manner by heating elements to the temperature of the first stage of 80 K.

Secondly, a thermal bridge is known in the case of cryogenic pumps which conduct heat from the housing of the cryogenic pump to the temperature zones of the base of the shield, so the memory effect is likewise prevented.

The drawback of these proposals is that heat is in each case supplied from outside to the cold head during operation of the cryogenic pump and the cooling capacity of the second stage, and consequently the efficiency of the cryogenic pump, is reduced.

The present invention provides a cryogenic pump that does not exhibit the drawback described above. In other words, the present invention provides a cryogenic pump that does not have the memory effect.

SUMMARY OF THE INVENTION

According to the invention, a device comprises a thermal bridge provided between the shield and the first cooling stage at a spacing from its end side. This has the advantage that the thermal bridge is connected to a temperature zone of the first cooling stage which has a higher temperature than the temperature which prevails on the end side of the first cooling stage. New cryogenic pumps may be fitted with the device according to the invention. However, it is also conceivable to retrofit cryogenic pumps, which are already in use with the device.

The position of the thermal bridge on the first cooling stage is advantageously fixed in such way that a temperature between 70 and 90 K, or about 80 K, is established at the shield during operation of a cryogenic pump. The memory effect stated above can be prevented in this way if this temperature range prevails at the entire surface of the shield. As a result of the fact that the heat is provided by the first cooling stage for transfer via the thermal bridge, external heat sources can be dispensed with, so the efficiency of the cryogenic pump is not reduced at the second stage.

A connecting piece is expediently provided on the base of the shield and this is connected in a thermally conductive manner only by its distal end to the first cooling stage. This ensures that cold is only removed from a temperature range of the first cold stage which matches the optimal operating temperature at the shield.

The internal diameter of the connecting piece is advantageously greater than the external diameter of the first cooling stage. The connecting piece is therewith not thermally conductively connected to the first cooling stage at any point other than its distal end, and this allows the desired operating temperature of the cryogenic pump to be adhered to exactly.

It is advantageous that the connecting piece has a flange on the side facing the shield and this serves as a thermal bridge between the connecting piece and the shield. This guarantees good heat transfer, attributed to an enlarged connecting piece surface, between the connecting piece and the shield.

The flange is expediently spaced apart from the second cooling stage. This prevents an undesirable cold transfer from the second cooling stage to the flange and the spacing also serves as insulation between the flange and the second cooling stage.

A gap is advantageously provided between the flange and the first cooling stage, so the end side of the first cooling stage, at which temperatures of about 30 K prevail, cannot come into contact with the flange either.

Due to the fact that a cover, which is connected to the connecting piece by means of at least one web, is arranged inside the baffle, the desired temperature is advantageously conducted directly from the web without loss to the cover and therefore the baffle and shield as well.

The fact that the connecting piece and the flange adjoining the connecting piece are made from copper has the advantage that copper has outstanding heat-conducting properties and heat is transferred with low losses. Other materials with heat conductivity values which are just as good as copper would also be possible.

A further subject matter of the present invention is also a cryogenic pump according to claim 11 with a device described above according to any one of claims 1 to 10. The cryogenic pump, which accommodates the cold head according to the invention, has the advantage that its dimensions are exactly adjusted to the capacity of the cold head.

BRIEF DESCRIPTION OF THE DRAWINGS

An exemplary embodiment of the invention will be described in more detail below with reference to the figures in schematic view and in which.

DETAILED DESCRIPTION OF THE INVENTION

Figure 1:
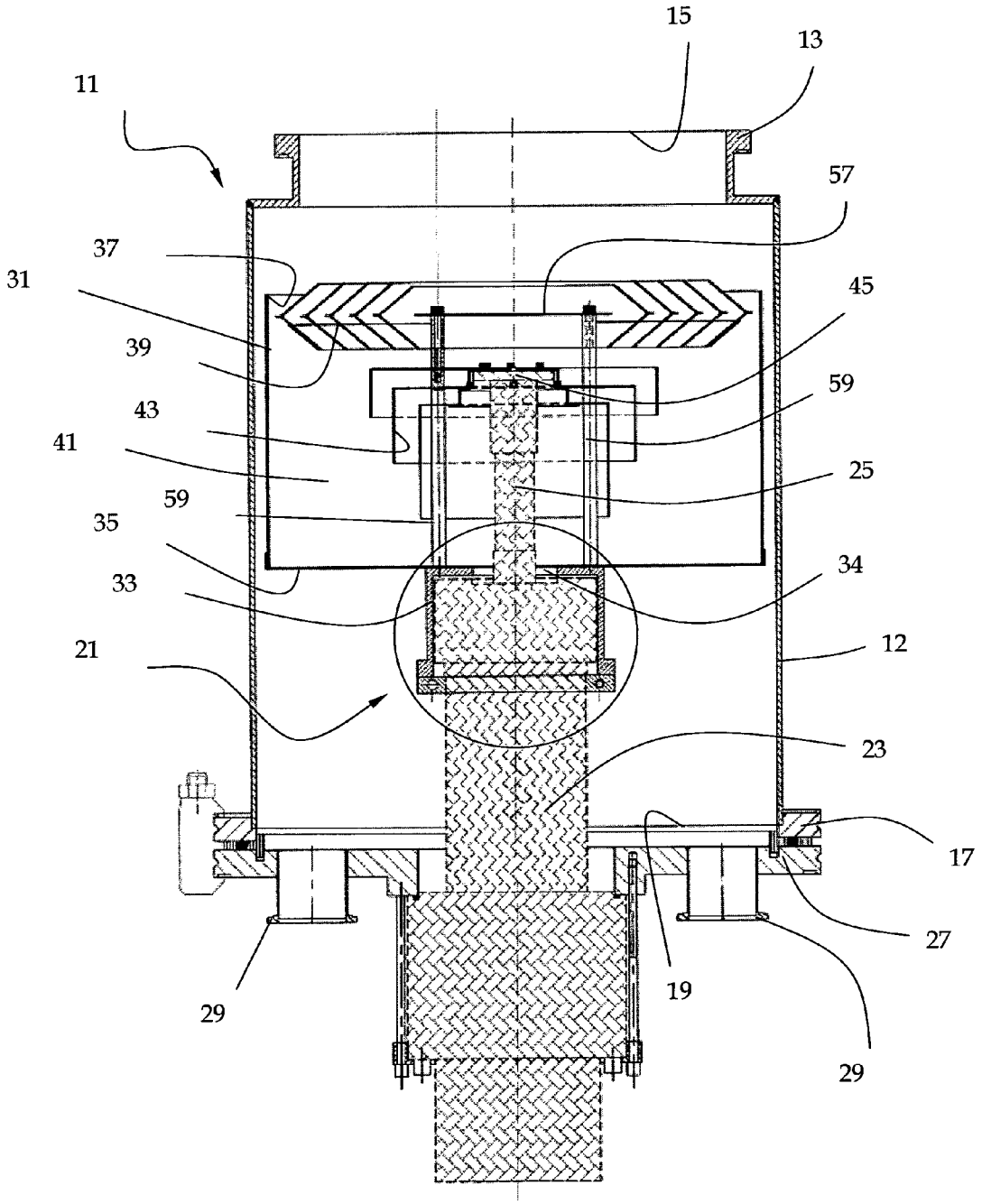
FIG. 1 shows a cross-section through a cryogenic pump.

The cryogenic pump 11 shown in FIG. 1 has a housing 12. At its first end the housing 12 is fitted with a flange 13 which forms the intake opening 15 of the cryogenic pump 11 and with which the cryogenic pump 11 is connected to a recipient (not shown in detail), such as with interconnection of a valve. A second flange 17, which surrounds a receiving opening 19, is provided at the second end of the housing 13 opposing the first.

A two-stage cold head 21 is accommodated in the housing 12 and has a first, warmer cooling stage 23 (kept at about 30 K) and a second, colder cooling stage 25 (kept at about 10 K) which axially adjoins the first stage 21. The first cooling stage 23 is centrally secured to a cold head flange 27 which is in turn connected to the second flange 17. Arranged concentrically around the first cooling stage 23 and on the cold head flange 27 are connecting flanges 29. The connecting flanges 29 serve to connect monitoring instruments, pressure and temperature measuring instruments by way of example, which monitor the state of the pump during operation.

A shield 31, which serves as a first pumping surface area, is connected by a thermal bridge 33 to the first cooling stage 23 in a very thermally conductive manner. To improve thermal conductivity further the thermal bridge may be made from copper. An intermediate space 34 is therefore formed between the shield 31 and the end side 55 of the first cooling stage 23 and is bridged by the thermal bridge 33. At the transition between the first and second cooling stages the thermal bridge 33 is not directly connected to the second cooling stage 25 and instead part of the intermediate space 34 remains free in the form of a circular ring. The shield 31 has the form of a cylinder on which a base 35 is provided on the side facing the first cooling stage 23. An opening 37 is provided on the side facing away from the first cooling stage 23.

An interior space 41 is formed by the shield 41 and a baffle 39 arranged in the region of the opening 37. The baffle 37 is supported by the shield 31 and webs 59 and serves to freeze vapours, such as for example water vapour. Cooling elements 43 are located in the interior space 41 and serve as a second pumping surface area. The cooling elements have the form of cups with different diameters which are partially moved into each other. To reach the temperature of the second cooling stage 25 the cooling elements 43 are connected to the second cooling stage 25 by fixing elements 45 in a very thermally conductive manner.

The base 35 of the shield 31 is centrally penetrated by the cold head 21 in such a way that the first cooling stage is located outside of the interior space 41 and the second cooling stage 25 is located in the interior space 41. In the region of the shield 31 and the baffle 39 the temperature is determined by the thermal bridge 33 which transfers the temperature, prevailing at the end side 55 of the first cooling stage 23, of about 30 K to the base 35, shield 31 and baffle 39. In the case of cryogenic pumps according to the prior art this produces temperature zones at the base 35 which have a temperature of about 30 K.

During the evacuation process gases also pass into the interior space 41 and these condense at 30 K and do not freeze. A typical gas with these properties is argon by way of example. As these gases are in the form of a liquid at the 30 K zones they also have a corresponding vapour pressure. Since an ultra-high vacuum is to be achieved using cryogenic pumps, even the smallest increase in pressure, which results by way of example due to the vapour pressure of liquefied gases, has an adverse effect on the vacuum to be achieved. This reduced vacuum performance, which comes about due to liquefied gases in the interior space 41, is called the memory effect in cryogenic pumps of the prior art.

Figure 2:
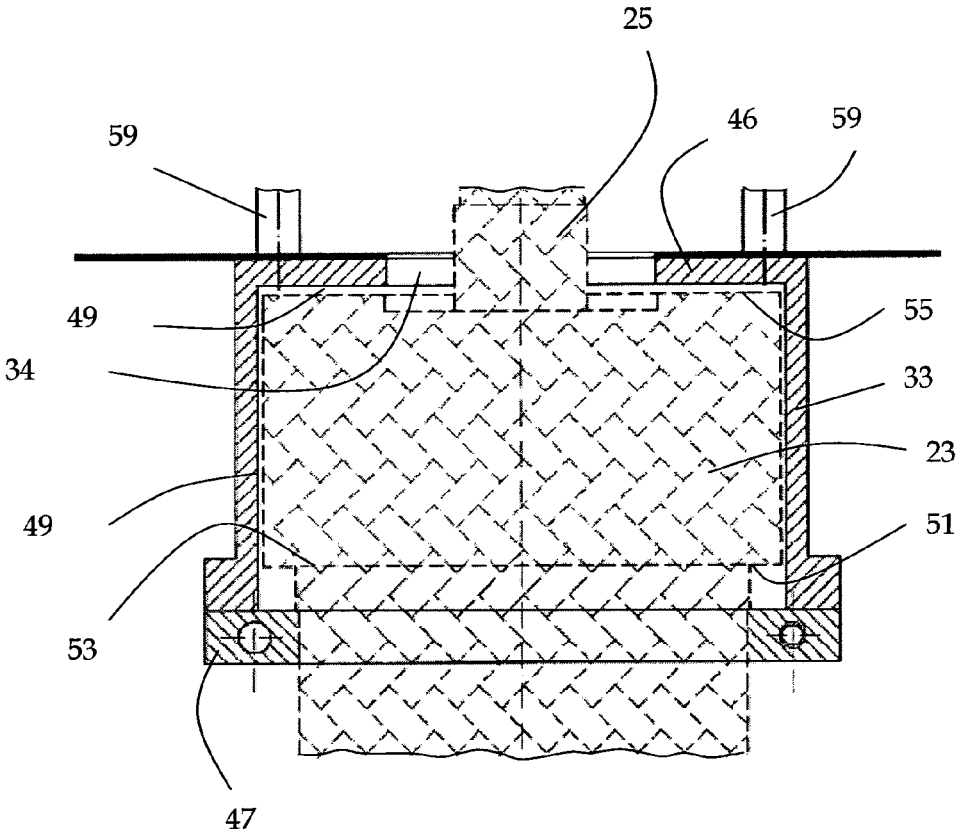
FIG. 2 shows a detailed view of a thermal bridge from FIG. 1.

In order for this memory effect to be overcome one aspect of the invention is to not allow 30 K zones to come about anywhere on the shield. The construction of the thermal bridge 33 can be clearly seen in FIG. 2. The thermal bridge 33 is connected to the temperature zone of the first cooling stage 23 in a heat-conducting manner, the zone having a temperature of about 80 K. This temperature is transferred by the thermal bridge 33 to the base 35. It is important that the thermal bridge 33 is formed in such a way that it is led as close as possible to the second cooling stage 25. In the exemplary embodiment this requirement is met by the thermal bridge 33 having the form of a connecting piece 33. Provided on the side facing away from the base 35 of the shield 31 is a flange 46 which serves to provide the efficient heat-conducting connection of the thermal bridge 33 to the base 35. A clamped connection in the form of a clip 47 is provided to connect the thermal bridge 33 to the first cooling stage 23 and this is pressed onto the first cooling stage 23 by two screws. Other connections which can be non-destructively detached are also conceivable.

A gap 49 is provided between the thermal bridge 33 and the first cold head to ensure that contact with the first cooling stage 23 is produced solely by the clip 47. The gap 49 comes about on the one hand in that the external diameter 51 of the first cooling stage 23 is designed smaller than the internal diameter 53 of the thermal bridge 33. On the other hand, the height of the thermal bridge is dimensioned such that a gap 49 is provided between the end side 55 of the first cooling stage 23 and the flange 46.

It is important that the baffle 39 and the cover 57 are also brought to the temperature level of the shield. The baffle 39 and the cover 57 also serve to shield the cooling elements 43 from gases and vapours which should freeze at 80 K already. So the temperature of the baffle 39 and the cover 57 are substantially at the temperature of the thermal bridge 33 they are held by webs 59 which are directly connected in a thermally conductive manner to the thermal bridge 33.

The person skilled in the art realises from the fact that the thermal bridge 33 obtains the heat for heating the base 35 from the first cooling head 23, and not from external heat sources, that the overall efficiency of the cryogenic pump is improved, even though the cooling time of the cryogenic pump must inevitably deteriorate slightly.

The invention claimed is:

1. An apparatus for preventing a memory effect in cryogenic pumps, comprising:

a two-stage device comprising a first cooling stage and a second cooling stage that adjoins the first cooling stage in an axial direction;

a cylindrical shield with an opening and a base, the base penetrated centrally by the two-stage device in such a way that the first cooling stage is arranged outside the cylindrical shield and the second cooling stage is arranged within the cylindrical shield, and an intermediate space is formed between the cylindrical shield and the first cooling stage, and the base of the cylindrical shield is connected in a thermally conductive manner to the first cooling stage by a thermal bridge, the thermal bridge positioned between the cylindrical shield and the first cooling stage at a distance from an end side of the first cooling stage;

a cooling panel providing a pumping surface area, the cooling panel connected to the second cooling stage and positioned within the cylindrical shield; and a baffle arranged proximate the opening of the cylindrical shield and in thermally conductive contact with at least one of the cylindrical shield and the first cooling stage.

2. The apparatus of claim 1, wherein a position of the thermal bridge is fixed on the first cooling stage to establish a temperature between 70 and 90 K at the shield during operation of a cryogenic pump.

3. The apparatus of claim 2, wherein the position of the thermal bridge is fixed on the first cooling stage to establish a temperature about 80 K.

4. The apparatus of claim 1, wherein the thermal bridge comprises a connecting piece, the connecting piece positioned on the base of the shield and connected in a thermally conductive manner only by a distal end thereof to the first cooling stage.

5. The apparatus of claim 4, wherein an internal diameter of the connecting piece is greater than an external diameter of the first cooling stage.

6. The apparatus of claim 4, wherein the connecting piece has a flange on a side thereof facing the shield, the flange providing the thermal bridge between the connecting piece and the shield.

7. The apparatus of claim 6, wherein the flange and the first cooling stage define a gap therein between.

8. The apparatus of claim 6, wherein the flange is spaced apart from the second cooling stage.

9. The apparatus of claim 4, further comprising a cover positioned inside the baffle and connected to the connecting piece by means of at least one web.

10. The apparatus of claim 6, wherein the connecting piece and the flange are made from copper.

11. The apparatus of claim 1, wherein the two-stage device, the cylindrical shield, the cooling panel and the baffle are positioned within a housing.

12. A cryogenic pump, comprising:

a housing with a first connecting flange having a first opening for connection to a chamber to be evacuated;

a second connecting flange for securing a cold head in the housing; and a device for preventing a memory effect in cryogenic pumps positioned within the housing, the device comprising:

a two-stage device comprising a first cooling stage and a second cooling stage that adjoins the first cooling stage in an axial direction;

a cylindrical shield with an opening and a base, the base penetrated centrally by the two-stage device in such a way that the first cooling stage is arranged outside the cylindrical shield and the second cooling stage is arranged within the cylindrical shield, and an intermediate space is formed between the cylindrical shield and the first cooling stage, and the base of the cylindrical shield is connected in a thermally conductive manner to the first cooling stage by a thermal bridge, the thermal bridge positioned between the cylindrical shield and the first cooling stage at a distance from an end side of the first cooling stage;

a cooling panel providing a pumping surface area, the cooling panel connected to the second cooling stage and positioned within the cylindrical shield; and a baffle arranged proximate the opening of the cylindrical shield and in thermally conductive contact with at least one of the cylindrical shield and the first cooling stage.

13. The apparatus of claim 12, wherein a position of the thermal bridge is fixed on the first cooling stage to establish a temperature between 70 and 90 K at the shield during operation of a cryogenic pump.

14. The apparatus of claim 12, wherein the thermal bridge comprises a connecting piece, the connecting piece positioned on the base of the shield and connected in a thermally conductive manner at a distal end thereof to the first cooling stage.

15. The apparatus of claim 14, wherein an internal diameter of the connecting piece is greater than an external diameter of the first cooling stage.

16. The apparatus of claim 14, wherein the connecting piece has a flange on a side thereof facing the shield, the flange providing the thermal bridge between the connecting piece and the shield.

17. The apparatus of claim 16, wherein the flange and the first cooling stage define a gap therein between.

18. The apparatus of claim 16, wherein the flange is spaced apart from the second cooling stage.

19. The apparatus of claim 14, further comprising a cover positioned inside the baffle and connected to the connecting piece by at least one web.

20. The apparatus of claim 16, wherein the connecting piece and the flange are made from copper.

* * * * *